United States Patent [19]

Luther et al.

[11] 3,948,178

[45] Apr. 6, 1976

[54] PROPELLENT-CHARGE CARTRIDGE CASE

[75] Inventors: Hans Werner Luther, Holzbuttgen; Jürgen Prochnow, Dusseldorf, both of Germany

[73] Assignee: Rheinmetall G.m.b.H., Dusseldorf, Germany

[22] Filed: Feb. 11, 1974

[21] Appl. No.: 441,002

[30] Foreign Application Priority Data

Feb. 17, 1973 Germany ..... 2307907

[52] U.S. Cl. ..... 102/43 R

[51] Int. Cl.[2] ..... F42B 5/26

[58] Field of Search ..... 102/43 R, 43 P

[56] References Cited

UNITED STATES PATENTS

| | | | |
|---|---|---|---|
| 3,363,562 | 1/1968 | Stadler et al. | 102/43 P |
| 3,771,452 | 11/1973 | Reed et al. | 102/43 R |

FOREIGN PATENTS OR APPLICATIONS

| | | | |
|---|---|---|---|
| 13,425 | 11/1885 | United Kingdom | 102/43 R |
| 371,382 | 1/1907 | France | 102/43 R |
| 3,258 | 1865 | United Kingdom | 102/43 R |
| 11,685 | 5/1884 | United Kingdom | 102/43 R |

*Primary Examiner*—Samuel Feinberg
*Assistant Examiner*—C. T. Jordan
*Attorney, Agent, or Firm*—Ernest G. Montague; Karl F. Ross; Herbert Dubno

[57] ABSTRACT

A propellent-charge cartridge case which comprises a cartridge-case stub which has a cartridge-case wall and includes at least one part provided with a resilient gas check which can be pressed against a barrel wall. The cartridge-case wall is formed with an annular groove cut from the outside into the cartridge-case wall which weakens the cross section of the wall. A resilient insert fills the annular groove so that as gas pressure builds up within the cartridge case upon firing, the cartridge case stub is deformed in the region of the annular groove so as to reduce the size thereof and squeeze the insert out of the annular groove in gas-sealing manner against the barrel wall.

2 Claims, 5 Drawing Figures

PROPELLENT-CHARGE CARTRIDGE CASE

The present invention refers to a propellent-charge cartridge case comprising a cartridge-case stub including one or more parts which is provided with a resilient gas check or seal which can be pressed against the barrel wall.

Cartridge cases in which a gas-checking layer is inserted into the bottom of the cartridge case simultaneously with the paper case have been known for a long time. In this way it is intended to create both a sealing of the connecting place between the shaft of the cartridge case and the bottom of the cartridge, and a release of this connection from pressure.

In other known cartridge cases, a steel jacket is fastened to the inside of the cartridge-case bottom, against which jacket the paper case is bonded, the rib of the jacket which rests against the barrel wall being intended to provide a better seal. Aside from the fact that the steel jacket is substantially screened from the pressure of the gas by the paper case which rests against it from the inside, it is also scarcely suited from the standpoint of material as a seal.

Finally, there are also known cartridge cases in which the lower edge of the burnable body of the cartridge case is clamped in a tripartite cartridge-case bottom. In this connection, a cup-like plastic part is seated on the inside of the flat steel bottom, said plastic part having a cylindrical portion which corresponds to the cartridge-case wall and against which the lower edge of the burnable cartridge case rests from the inside. A second cup-shaped metal shell is seated on the plastic cup and by its cylindrical portion clamps the cartridge-case wall fast between itself and the plastic cup.

Since the cylindrical part of the plastic cup is screened off by the burnable and the metal cup from the gas pressure of the propellent charge, a dependable sealing with respect to the barrel wall cannot be obtained in this way, particularly when one wishes to replace the plastic cup by one of metal.

Accordingly, it is an object of the present invention to provide a propellent-charge cartridge case which avoids these disadvantages.

It is another object of the present invention to improve propellent-charge cartridge-cases having a gas check, packing or sealing in such a manner that upon the shooting, a dependable seal is assured between the barrel wall and the propellent-charge cartridge case with respect to the gas pressure which builds up within the cartridge case during each phase of the variation of the pressure, but which enables a convenient removal of the empty cartridge case from the chamber.

In accordance with the present invention, this object is achieved by an annular groove which is cut from the outside into the wall of the cartridge case and weakens the cross-section of the jacket, and by a resilient insert which fills the annular groove; as a result the gas pressure which builds up in the inside of the cartridge case upon shooting deforms the cartridge-case stub in the region of the annular groove by a reduction in size of the annular groove, that the insert is pressed in gas-checking manner against the barrel wall by the squeezing out thereof from the annular groove.

The squeezing out of the insert against the wall of the barrel can, in accordance with another feature of the present invention, be assisted by providing, distributed on the circumference, a plurality of channels which extend from the annular groove up to the inner cartridge-case jacket, through which channels the insert is directly acted on by the pressure of the gas.

It is yet another feature of the present invention, the fact that the annular groove which contains the insert has associated with it an annular groove which is located opposite it on the inner cartridge-case wall and additionally weakens the cross section of the cartridge case.

Still yet in accordance with still another feature of the present invention, the annular groove can be cut obliquely into the cartridge case and can have a depth of which exceeds its width, there remaining in the direction of shooting a narrow annular rib which, due to the gas pressure, presses into the annular groove provided with the insert, a thin-walled sealing lip representing the cartridge-case stub and connected with the annular rib being adapted to be pressed in gas-checking manner against the barrel wall at the same time as the insert.

These and other objects will become apparent from the following detailed description, in connection with the accompanying drawing, in which:

FIG. 1 is a longitudinal cross-sectional view of a propellent charge cartridge case with an outer annular groove and an inner annular groove located opposite each other;

FIG. 1*a* is a portion of FIG. 1 on a larger scale showing the annular groove deformed after firing;

Figure 1:
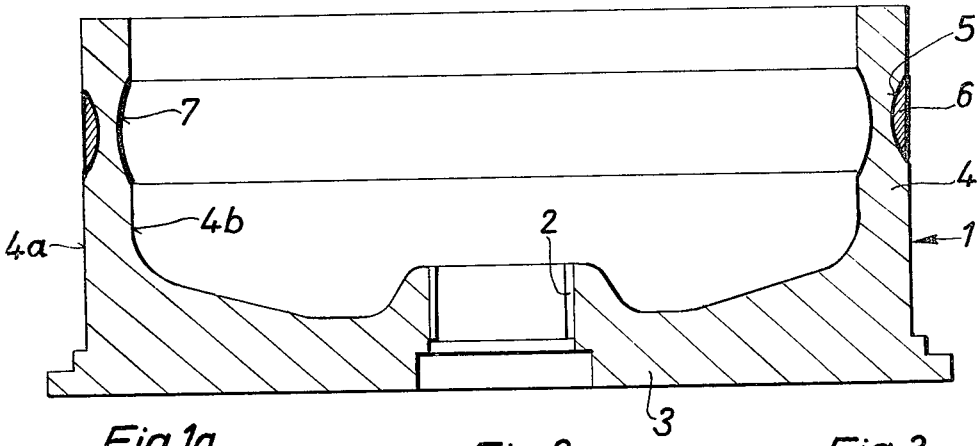
Figure 1A:
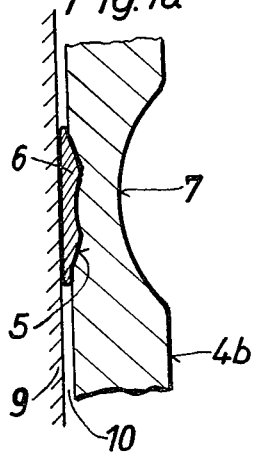

Referring now to the drawings, in accordance with the present invention, a propellent-charge cartridge case 1 comprises essentially a cartridge-case bottom 3 which receives the threaded primer 2 and a cartridge-case stub 4 which may be used either as is or lengthened or extended by a burnable cartridge case. In front of the free end of the cartridge-case stub 4 on the outer wall 4*a* of the cartridge case there is recessed an annular groove 5 having a circular arc-segmental section which is filled to the surface of the wall with an insert 6 of a resilient material. The insert 6 may comprise either an elastic or plastic material, such as rubber, plastic or silicone rubber, or of a metallic material of low strength and high ductility, such as copper, soft iron, sintered metal or lead.

Figure 2:
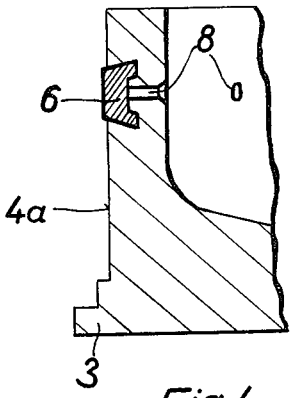
FIG. 2 is a portion of the cross section of the cartridge case with an annular groove and channels distributed on the periphery.
Figure 3:
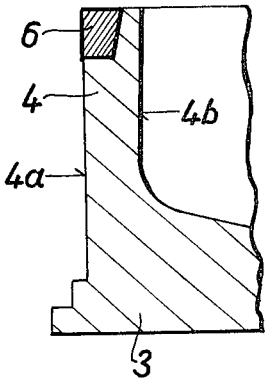
FIG. 3 is a portion of the cross section of the carriage case with an annular groove cut on the free end of the cartridge case.

The weakening of the cross section caused by the annular groove 5 can, in the case of the embodiments shown in FIGS. 1 to 3, be made even more effective by a second annular groove 7 on the inner wall 4*b* of the cartridge case which lies opposite the annular groove 5.

In the embodiment shown in FIG. 2, there are provided a number of channels 8 which connect the inner and outer cartridge-case walls 4*a* and 4*b* with each other via the annular groove 5.

In this way the possibility is afforded that an even better gas check can be obtained on the insert 6 not only via the deformation of the annular groove 5, but also via direct by the gases of the propellent charge.

The embodiment shown in FIG. 3 of an annular groove 5 cut in the free end of the cartridge-case stub 4 has the advantage that in this way the annular slot 10 formed between the cartridge-case stub 4 and the barrel wall 9 is held closed right at the inlet by the insert 6 which has been converted into a gas check, whereby erosion of the chamber is avoided.

Figure 4:
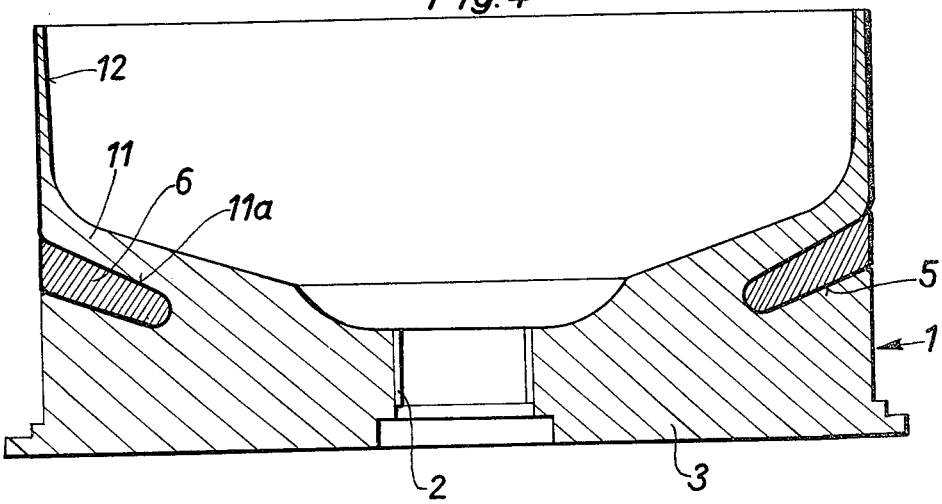
FIG. 4 is a longitudinal section of a propellent-charge cartridge case with an obliquely arranged annular groove.

In contradistinction to the previous embodiments in which the depth of the annular groove 5 is comparatively smaller than the width of the annular groove, FIG. 4 shows an obliquely cut annular groove 5, the depth of which is several times greater than its width. In this way there remains a narrow annular rib 11 which is adjoined by the edge of the cartridge case in the form of a thin-walled sealing lip 12.

In the embodiments of FIGS. 1 to 3, as the gas pressure builds up within the cartridge case, the cartridge-case stub 4 is pressed outwardly by deformation in the region of the annular grooves 5 and 7, as a result of which the insert 6 is partially squeezed out of the annular groove 5 and pressed against the barrel wall 9. This process is furthermore effectively supported by the direct access of the gases of the propellent charge to the insert 6 via the channels 8.

FIG. 1 shows the insert 6 in the form of the gas check packing or sealing which closes the annular gap 10. If, on the other hand, the gas pressure increases within the cartridge case, in the embodiment shown in FIG. 4, the side or flank 11*a* of the annular rib 11 facing the annular groove 5 is pressed into the annular groove 5 so that the annular rib 11 is perpendicular, relative to the axis of the barrel, the sealing lip 12 also being carried along and coming to rest in sealing fashion against the barrel wall 9. The reduction in size of the annular groove 5 has the result that the insert 6 is partially squeezed out of the compressed annular groove 5 and pressed against the barrel wall 9. In this way a double gas check or sealing is effective which is assured both by the sealing lip 12 and by the insert 6.

Within the scope of the invention, the insert 6, as shown in FIG. 2, can extend beyond the periphery of the outer cartridge-case wall 4*a*. In this way both a precompressing of the cartridge case with respect to the barrel wall 9 and a better fit of the cartridge case in the barrel is obtained, which has an advantageous effect, in particular, in the case of a large elevation of the barrel.

All combination features set forth herein in the claims, and particularly the spatial development and structural development disclosed, are essential to the present invention.

We claim:

1. A propellent-charge cartridge case comprising a cartridge-case stub having a base and a cartridge case wall extending axially from said base, an annular external groove formed in said wall and adapted to be juxtaposed with the internal wall of a barrel receiving the cartridge case, a resilient insert filling said annular groove and adapted to be pressed against said barrel wall upon the discharge of a charge received in said case, and an internal groove in said cartridge case wall in the region of said external groove for weakening said cartridge case wall.

2. In a cartridge having a propellent charge and adapted to sealingly engage a barrel in which said cartridge is discharged, the improvement which comprises a cartridge case having an annular wall confronting a wall of said barrel; a groove formed in said wall of said cartridge case and opening in the direction of said barrel wall; a region of reduced cross section along said wall of said cartridge case at said groove deformable outwardly by the firing of a charge within said cartridge; and a resilient insert received in said groove and displaced at least partly therefrom upon deformation of said region into sealing engagement with said wall of said barrel, said wall of said case being formed with an internal groove in the plane of the first mentioned groove and defining therewith said region.

* * * * *